United States Patent [19]

Petrovich

[11] 4,455,223

[45] Jun. 19, 1984

[54] FROTH FLOTATION METHOD FOR RECOVERING METAL VALUES WITH POLYHYDROXY FATTY ACIDS

[76] Inventor: Vojislav Petrovich, 1935 W. Schiller St., Chicago, Ill. 60622

[21] Appl. No.: 416,288

[22] Filed: Sep. 9, 1982

Related U.S. Application Data

[63] Continuation-in-part of Ser. No. 241,560, Mar. 9, 1981, Pat. No. 4,368,116.

[51] Int. Cl.[3] ..... B03D 1/14

[52] U.S. Cl. ..... 209/167

[58] Field of Search ..... 209/166, 167

[56] References Cited

U.S. PATENT DOCUMENTS

| | | | |
|---|---|---|---|
| 1,912,433 | 6/1933 | Crago et al. | 209/166 |
| 2,012,609 | 8/1935 | Lenher | 209/166 |
| 2,023,387 | 12/1935 | Harris | 209/166 |
| 2,099,120 | 11/1937 | Kirby et al. | 209/166 |
| 2,120,217 | 6/1938 | Harris | 209/166 |
| 2,362,432 | 11/1944 | Cahn | 209/166 |
| 3,859,208 | 1/1975 | Knocke et al. | 209/166 |
| 3,909,399 | 9/1975 | Petrovich | 209/166 |
| 4,148,720 | 4/1979 | Wang et al. | 209/166 |
| 4,362,552 | 12/1982 | Petrovich | 209/166 |
| 4,368,116 | 1/1983 | Petrovich | 209/166 |

FOREIGN PATENT DOCUMENTS

| | | | |
|---|---|---|---|
| 340598 | 1/1931 | United Kingdom | 209/166 |

*Primary Examiner*—Bernard Nozick

*Attorney, Agent, or Firm*—Vojislav Petrovich

[57] ABSTRACT

An improved method in concentration of oxide ores by froth flotation process which comprises subjecting a sufficiently fine sized ore of a metal which can change the valency state from lower to higher by the action of inorganic oxidizing compounds in the presence of an effective amount of a polyhydroxy fatty acid collector-frother; the indicated compounds provide selectivity and/or recovery of oxide minerals of iron, chromium, cerium, antimony, arsenic, titanium, zirconium, thorium, vanadium, niobium, tantalum, and wolfram, over silica and silicate gangue.

1 Claim, No Drawings

FROTH FLOTATION METHOD FOR RECOVERING METAL VALUES WITH POLYHYDROXY FATTY ACIDS

This invention is continuation in part of the invention Ser. No. 241,560 filed Mar. 9, 1981 now U.S. Pat. No. 4,368,116.

This invention relates to froth flotation of non-sulfide minerals from their ores using polyhydroxy fatty acids as collector-frothers, and more particularly by the addition of an oxidizing agent for the recovering of such metallic oxide minerals which consist of metals which can change the valency state from lower to higher by the action of inorganic oxidizing agents particularly such as ammonium persulfate and the like oxidizing agents which are added still to the grinding and sizing circuit. After the grinding and sizing the one of the chosen polyhydroxy fatty acid is added during the conditioning stage.

Accordingly, this invention has as an object the provision of a practical and economical process for the beneficiation of iron, chromium, cerium, antimony, arsenic, titanium, zirconium, thorium, vanadium, niobium, tantalum and wolfram minerals, which by the invented method are becoming amenable to froth flotation, which until now were concentrated by gravity method. Another object of this invention is to provide a mineral concentration treatment for the beneficiation of said metallic minerals, i.e., metal values involving selective activation of a desired mineral and the production of a high-grade concentrate with maximum recovery of desired metallic mineral of above enumerated metals with a very low consumption of reagents.

Accordingly, this invention is to provide an improved froth flotation procedure in which through the application of polyhydroxy fatty acids in conjunction with inorganic oxidizing agents which change the valency state at the surface of minerals, which thus activated for adheding the chosen and used polyhydroxy fatty acid makes that wanted minerals set free from the gangue and selected from the group of iron, chromium, cerium, antimony, arsenic, titanium, zirconium, thorium, niobium, tantalum, and wolfram in respective ores are activated and floated in the froth formed by agitating and aerating the pulp of mineral slurry.

In said invention the potassium salt of

Dihydroxystearic acid $CH_3(CH_2)_7\underset{\underset{OH}{|}}{CH}-\underset{\underset{OH}{|}}{CH}-CH_2(CH_2)_7-COOH$ Dihydroxyoleic acid $$CH_3(CH_2)_2-\underset{\underset{OH}{|}}{CH}-\underset{\underset{OH}{|}}{CH}-(CH_2)_3-CH=CH-(CH_2)_7COOH$$

are applied with great success in said investigations.

By applying the present invention it is feasible to obtain not only selected metal value, but also an increased recovery of enumerated metal values in respective froth concentrates, with a reduction in reagent requirement and costs, a substantial advance is feasible in the field of recovering of diverse minerals.

A further object of this invention is to provide a process requiring one flotation operation to produce a finished concentrate with a reduction in reagent requirements and costs, and an increase in mineral recovery. A further object is to provide a process which tolerates relatively large amount of −150 mesh slimes without serious affecting reagent consumption or metallurgical results, so that the desliming and sizing of the feed is less critical. A further object of this invention is to provide a process permitting the plant to operate efficiently at lower conditioning time and lower percent of solids levels.

In carrying out this invention in accordance with the foregoing principle, the selected ore is ground, sized, and then preferrably although not necessarily deslimed by washing to remove colloidally dispersed material, and thereafter the sands are diluted to a pulp consistency of generally about 25 percent solids. Thereafter, the pulp is conditioned for several minutes by agitating with an amount of the order from 0.02 to 0.2 kg per ton of ore treated of ammonium persulfate the oxidizing agent and simultaneously is added dihydroxyoleic acid or dihydroxystearic acid or their potassium salts in an amount of the order from 0.01 to 0.1 kg per ton of ore treated. Said additions to a distinct pulp of mineral slurry produce a floating froth product of selected mineral of the respective mineral slurry by agitating and aerating. Besides a rougher a cleaner procedure may be employed, and the invention can well be utilized in a cyclic process wherein the decanted and filtered spent water and the middling ore fraction are returned to the process, saving in this way the unused reagents, as well as omitting the spoiling of environment water courses.

The invented process further reduces the need for close plant control in critical areas, such as desliming, sizing, conditioning, and reagent rates, reducing flotation reagents requirement and processing costs. Thus, efficient results and considerable reagent economy have been effected in the practicing this invention, and to this end it is preferred to employ said polyhydroxy fatty acids or their potassium salts in small amount only, because they develop sufficient froth, being thus effective collector-frother.

The following examples will facilitate a more complete understanding of the present invention but they are not meant to limit the scope of the invention to the specific embodiments incorporated therein.

TABLE I

| Example ore treated | Promoter Kg/t | Collector Kg/t | Feed % | Conc. % | Tailing % |
|---|---|---|---|---|---|
| 1. Specular hematite | Ammonium persulfate 0.05 | Dihydroxyoleic potassium salt 0.04 | Fe 29.7 | Fe 61.8 | Fe 8.4 |
| 2. Chromite | the same 0.05 | the same 0.04 | $Cr_2O_3$ 21.0 | $Cr_2O_3$ 49.1 | $Cr_2O_3$ 4.4 |
| 3. Monazite | the same 0.03 | the same 0.02 | by weight 9.2 | by weight 63.0 | by weight 0.7 |
| 4. Cervantite | the same 0.06 | the same 0.04 | Sb 18.4 | Sb 56.2 | Sb 2.1 |
| 5. Rutile | the same | the same | Ti | Ti | Ti |

TABLE I-continued

| Example ore treated | Promoter Kg/t | Collector Kg/t | Feed % | Conc. % | Tailing % |
|---|---|---|---|---|---|
| | 0.04 | 0.03 | 12,4 | 52,4 | 2.2 |
| 6. Zircon flour | the same 0.08 | the same 0.06 | pure | pure | — |
| 7. Niobium Tantalum | the same 0.05 | the same 0.03 | 4% by weight | good conc. | good tailing |
| 8. Wolframite | the same 0.05 | the same 0.03 | 3.3 by weight | good conc. | good tailing |
| 9. Chromite | the same 0.06 | Dihydroxystearic potassium salt 0.6 | $Cr_2O_3$ 21.0 | $Cr_2O_3$ 52.4 | $Cr_2O_3$ 2.1 |

All investigated ores with polyhydroxy fatty acids and ammonium persulfate yielded high recoveries and pure concentrates. In each tailing it was visible under the microscope only the coarse grains of wanted minerals.

Table I, shows that polyhydroxy fatty acids in conjunction with an oxidizing agent are excellent collector-frothers for metallic minerals of various metals such as of iron, chromium, cerium, antimony, arsenic, titanium, zirconium, thorium, vanadium, niobium, tantalum, and wolfram.

Considering the results, the conclusion is: that not only the ratio of concentration of valuable minerals is considerably raised, but also is highly performed with reagents which until now have not been known and used in froth flotation of minerals. A feasible froth flotation process is modiffied by which the ratio of depressed gangue is considerably lowered, while the ratio of the valuable mineral is considerably hightened. Therefore, the use accordingly to the present invention of polyhydroxy fatty acids in conjunction with oxidizing agents for accomplishing the purpose of collecting minerals of iron, chromium, cerium, antimony, arsenic, titanium, zirconium, thorium, vanadium, niobium, tantalum, and wolfram in a process of unaffected gangue and certain secondary valuable minerals occasionally present in a distinct mineral slurry constitutes a marked advance in the art of froth flotation, and is highly advantageous in improving the selectivity by the used collectors, thus improving the grade of concentrate.

What is claimed is:

1. In concentrating by froth flotation of metallic ores selected from the group of iron, chromium, cerium, antimony, arsenic, titanium, zirconium, thorium, vanadium, niobium, tantalum, and wolfram, which includes the subjecting of such ore material when finely ground to froth flotation process in the presence of dihydroxy stearic acid, or dihydroxy oleic acid, or their potassium salts, and in the presence of ammonium persulfate; the step of adding to the mineral slurry an amount of the order from 0.01 to 0.1 kg per ton of ore treated of said dihydroxy fatty acids, and an amount of the order from 0.02 to 0.2 kg per ton of ore treated of ammonium persulfate; said additions to aqueous dispersion of ore produce a froth floating product of said mineral values by continuing agitation and aeration of the aqueous dispersion of ore, and separating and recovering the wanted mineral value as float froth concentrate product.

* * * * *